US012336602B2

(12) United States Patent
Ikeguchi et al.

(10) Patent No.: US 12,336,602 B2
(45) Date of Patent: Jun. 24, 2025

(54) FASTENER STRINGER AND METHOD FOR MANUFACTURING FASTENER STRINGER

(71) Applicant: YKK Corporation, Tokyo (JP)

(72) Inventors: Yoshito Ikeguchi, Kurobe (JP); Masaki Meiwa, Kurobe (JP); Yukako Nakamura, Kurobe (JP); Hayato Iwamura, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 18/262,694

(22) PCT Filed: Feb. 4, 2021

(86) PCT No.: PCT/JP2021/004134

§ 371 (c)(1),
(2) Date: Jul. 24, 2023

(87) PCT Pub. No.: WO2022/168239

PCT Pub. Date: Aug. 11, 2022

(65) Prior Publication Data

US 2024/0074548 A1 Mar. 7, 2024

(51) Int. Cl.

| | |
|---|---|
| ***A44B 19/34*** | (2006.01) |
| ***A44B 19/08*** | (2006.01) |
| ***A44B 19/62*** | (2006.01) |

(52) U.S. Cl.

CPC ..... *A44B 19/343* (2013.01); *A44B 19/08* (2013.01); *A44B 19/62* (2013.01)

(58) Field of Classification Search

CPC ..... A44B 19/343; A44B 19/08; A44B 19/62; A44B 19/346; A44C 19/04

See application file for complete search history.

(56) References Cited

U.S. PATENT DOCUMENTS 3,590,881 A * 7/1971 Van Amburg ..... A44B 19/346 139/384 B
3,900,928 A 8/1975 Takamatsu
(Continued)

FOREIGN PATENT DOCUMENTS

JP 50-078403 7/1975
JP S54-035769 Y2 10/1979
(Continued)

OTHER PUBLICATIONS

International Search Report, PCT Patent Application No. PCT/JP2021/004134, Apr. 20, 2021, 5 pages.
(Continued)

*Primary Examiner* — Jack W Lavinder
(74) *Attorney, Agent, or Firm* — Kilpatrick Townsend & Stockton LLP

(57) ABSTRACT

A fastener stringer for a concealed slide fastener in which a knitted fastener tape has a tape main body portion and a doubled-tape portion that is formed by extending in a width direction from the tape main body portion and being folded back, wherein at least a chain stitch yarn is included in each wale forming the tape main body portion, and wales forming the doubled-tape portion have at least one wide wale having a second wale width that is greater than the first wale width of the wale forming the tape main body portion. The doubled-tape portion of the fastener tape can thereby be provided with superior flexibility.

4 Claims, 5 Drawing Sheets

(56) References Cited

U.S. PATENT DOCUMENTS

| | | | | | |
|---|---|---|---|---|---|
| 3,922,760 | A * | 12/1975 | Matsuda | A44B 19/406 | 24/393 |
| 3,974,549 | A * | 8/1976 | Matsuda | A44B 19/343 | 66/195 |
| 3,974,550 | A * | 8/1976 | Fujisaki | A44B 19/343 | 66/195 |
| 3,983,721 | A * | 10/1976 | Matsuda | A44B 19/343 | 24/396 |
| 4,015,449 | A * | 4/1977 | Matsuda | A44B 19/343 | 24/396 |
| 5,062,161 | A * | 11/1991 | Sutton | D02G 3/442 | 66/174 |
| 5,257,515 | A * | 11/1993 | Ikeguchi | A44B 19/343 | 66/202 |
| 7,293,434 | B2 * | 11/2007 | Ikeguchi | A44B 19/52 | 66/193 |
| 2004/0244157 | A1 * | 12/2004 | Matsuda | A44B 19/54 | 24/393 |
| 2012/0151718 | A1 * | 6/2012 | Hasegawa | D03D 1/00 | 24/400 |
| 2013/0174767 | A1 | 7/2013 | Hirokawa et al. | | |
| 2020/0187603 | A1 * | 6/2020 | Ikeguchi | D04B 21/08 | |
| 2022/0042218 | A1 * | 2/2022 | Uozumi | D04B 1/225 | |

FOREIGN PATENT DOCUMENTS

| | | | |
|---|---|---|---|
| JP | 55-047806 | A | 4/1980 |
| JP | S57-36005 | Y2 | 8/1982 |
| JP | 2020-092829 | A | 6/2020 |
| WO | 2012/042616 | A1 | 4/2012 |

OTHER PUBLICATIONS

Written Opinion, PCT Patent Application No. PCT/JP2021/004134, Apr. 20, 2021, 5 pages.

International Preliminary Report on Patentability, PCT Patent Application No. PCT/JP2021/004134, mailed Aug. 3, 2023, 8 pages.

* cited by examiner

PRIOR ART

FASTENER STRINGER AND METHOD FOR MANUFACTURING FASTENER STRINGER

TECHNICAL FIELD

The invention relates to a fastener stringer for a concealed slide fastener, and a method for producing the fastener stringer.

BACKGROUND ART

A concealed slide fastener formed by attaching a plurality of fastener elements to an element attaching portion of a knitted fastener tape with a machine sewing yarn is known. A fastener stringer used for such a concealed slide fastener is described in, for example, JP S57-36005 Y2 (Patent Document 1).

For example, as illustrated in FIG. 5, a fastener stringer 80 for a concealed slide fastener described in Patent Document 1 includes a knitted fastener tape 81 and coil-shaped fastener elements 82 attached to the fastener tape 81.

The fastener tape 81 includes a tape main body portion 81*a* and a doubled-tape portion 81*b* formed by extending in a width direction from the tape main body portion 81*a* and being folded back. The folded back tape portion of the doubled-tape portion 81*b* serves as an element attaching portion of the fastener tape 81, and the fastener elements 82 are attached to this element attaching portion with a machine sewing yarn (sewing yarn) 83.

In the fastener tape 81 of Patent Document 1, a knitting structure of the tape main body portion 81*a* is formed of a chain stitch yarn, a tricot stitch yarn, and a weft insertion yarn. The element attaching portion includes a first wale W1 formed on a tape side edge, and second and third wales W2 and W3 sequentially formed from the first wale W1 toward the tape main body portion 81*a*.

In Patent Document 1, the first and third wales W1 and W3 are formed using a chain stitch yarn, a tricot stitch yarn, and a weft insertion yarn. The second wale W2 is formed only of a tricot stitch yarn and a weft insertion yarn. Thus, the second wale W2 is formed to be thinner than the other wales of the fastener tape 81. In other words, the second wale W2 is formed to have a wale width (dimension in the width direction of the wale) smaller than that of the other wales. In addition, this makes the interval between the first and second wales W1 and W2 and the interval between the second and third wales W2 and W3 larger than the interval between the other adjacent wales.

When the fastener elements 82 are sewn to the fastener tape 81 knitted as described above with a sewing machine, since the interval between the first and second wales W1 and W2 and the interval between the second and third wales W2 and W3 are increased, sewing processing can be performed by piercing a sewing machine needle through these intervals smoothly. As a result, interference between the sewing machine needle and the fastener element 82 can be suppressed, and the plurality of fastener elements 82 can be stably fixed at predetermined positions of the fastener tape 81 at constant pitches.

CITATION LIST

Patent Document

Patent Document 1: JP S57-36005 Y2

SUMMARY OF INVENTION

Technical Problem

A conventional concealed slide fastener formed using, for example, the fastener stringer 80 described in Patent Document 1 is currently used for various kinds of clothing. When a concealed slide fastener is used for clothing, the concealed slide fastener is generally attached to an opening of the clothing to be opened and closed when the clothing is put on and taken off. Further, these days, in order to help putting on and taking off clothing, a concealed slide fastener is sometimes attached to a placket portion of clothing that facilitates a sliding operation of a slider.

However, in the conventional concealed slide fastener (fastener stringer), the above-described doubled-tape portion in which the fastener tape is folded back and overlaps is sometimes provided in a part of the fastener tape, and thus the concealed slide fastener has lower flexibility than a cloth (garment cloth) of clothing to which the concealed slide fastener is attached, which makes it easy to feel hardness (rigidity).

For this reason, when a person wearing the clothing to which the concealed slide fastener is attached bends down or sits on a chair, a portion of the clothing to which the concealed slide fastener is attached may become partially hard (stiffened), a convex portion (protruding portion) that partially bulges away from the body may be formed, and a concave portion that is recessed toward the body may be formed between the two convex portions. When the hard portion, the convex portion, the concave portion, and the like as described above are generated in the portion of the clothing to which the concealed slide fastener is attached at the time of wearing the clothing, the wear comfort of the clothing may be deteriorated, and the beauty of the silhouette and the design of the clothing at the time of wearing may be impaired.

The invention has been made in view of the above-described conventional problems, and aims to provide a fastener stringer for a concealed slide fastener in which flexibility in a doubled-tape portion of a knitted fastener tape to which a fastener element is attached is enhanced, and a method for manufacturing the fastener stringer.

Solution to Problem

In order to achieve the above object, a fastener stringer provided by the invention is a fastener stringer for a concealed slide fastener including a knitted fastener tape and a plurality of fastener elements attached to an element attaching portion of the fastener tape with machine sewing yarns, the fastener tape including a tape main body portion and a doubled-tape portion that is formed by extending in a width direction from the tape main body portion and being folded back, the doubled-tape portion including the element attaching portion, the fastener stringer being characterized in that at least a chain stitch yarn is included in each wale forming the tape main body portion, and wales forming the doubled-tape portion include at least one wide wale having a second wale width that is greater than a first wale width of the wale forming the tape main body portion.

In the fastener stringer according to the invention, it is preferable that at least one of the machine sewing yarns pierces between the wide wale and the wale adjacent to the wide wale in the doubled-tape portion.

In addition, it is preferable that the doubled-tape portion includes a first tape portion extending in the width direction from the tape main body portion, a tape bent portion extending from the first tape portion and bent in a U shape, and a second tape portion extending from the tape bent portion and overlapping with the first tape portion, and the wide wale be disposed at least in the tape bent portion.

Further, it is preferable that, when a wale formed on a tape side edge on the doubled-tape portion side of the fastener tape is defined as a first wale and a wale disposed Nth from the first wale toward an opposite tape side edge of the fastener tape is defined as an Nth wale, the doubled-tape portion is formed of five wales from the first wale to a fifth wale, and a second wale and a third wale forming the doubled-tape portion are each formed as the wide wale.

Further, in the invention, it is preferable that the tape main body portion and the doubled-tape portion include tricot stitch yarns and single satin stitch yarns, the tricot stitch yarns include a first tricot stitch yarn and a second tricot stitch yarn having higher strength or larger fineness than the first tricot stitch yarn and having a needle loop formed in the doubled-tape portion, and the single satin stitch yarns include a first single satin stitch yarn and a second single satin stitch yarn having higher strength or larger fineness than the first single satin stitch yarn and having a needle loop formed in the doubled-tape portion.

Further, it is preferable that one needle loop of a stitch yarn is formed in each course of a wale formed on a tape side edge of the fastener tape on a side opposite to the doubled-tape portion.

Next, a method for manufacturing a fastener stringer provided by the invention is a method for manufacturing a fastener stringer for a concealed slide fastener including a knitted fastener tape and a plurality of fastener elements attached to an element attaching portion of the fastener tape with machine sewing yarns, the fastener tape including a tape main body portion and a doubled-tape portion that is formed by extending in a width direction from the tape main body portion and being folded back, the doubled-tape portion including the element attaching portion, the method being characterized by including: knitting the fastener tape in which at least a chain stitch yarn is included in each wale forming the tape main body portion and a water-soluble chain stitch yarn is included in at least one of wales forming the doubled-tape portion; sewing the plurality of fastener elements to the element attaching portion of the knitted fastener tape by a sewing processing using a sewing machine; and dissolving and removing the water-soluble chain stitch yarn of the fastener tape to which the plurality of fastener elements are sewn to form, in the doubled-tape portion, at least one wide wale having a second wale width that is greater than a first wale width of the wale forming the tape main body portion.

In the manufacturing method of the invention, it is preferable that the method includes sewing the plurality of fastener elements to the element attaching portion by piercing at least one of the machine sewing yarns between the wale including the water-soluble chain stitch yarn and the wale adjacent to the wale including the water-soluble chain stitch yarn in the doubled-tape portion in the sewing processing.

Advantageous Effects of Invention

According to the invention, it is possible to provide a fastener stringer for a concealed slide fastener in which flexibility in a doubled-tape portion of a knitting fastener tape to which fastener elements are attached is enhanced.

DESCRIPTION OF EMBODIMENTS

Hereinbelow, a preferred embodiment of the invention will be described while citing an example with reference to the drawings.

Examples

Figure 1:
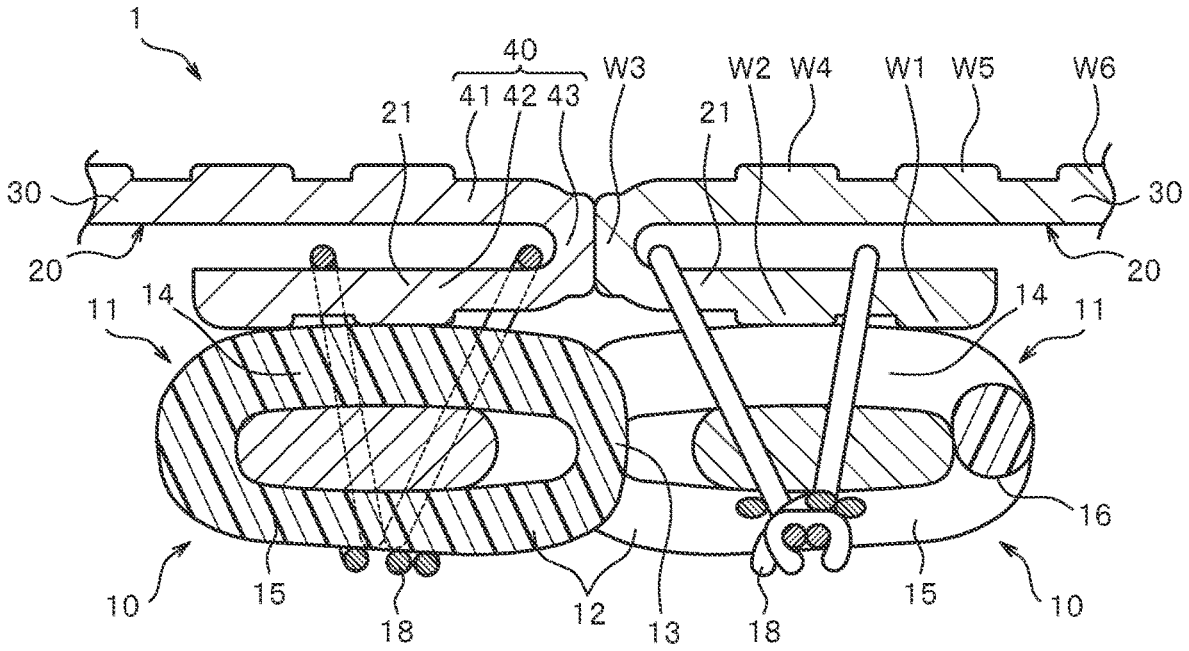
FIG. 1 is a cross-sectional view schematically illustrating a fastener stringer for a concealed slide fastener according to an example of the invention.
Figure 2:
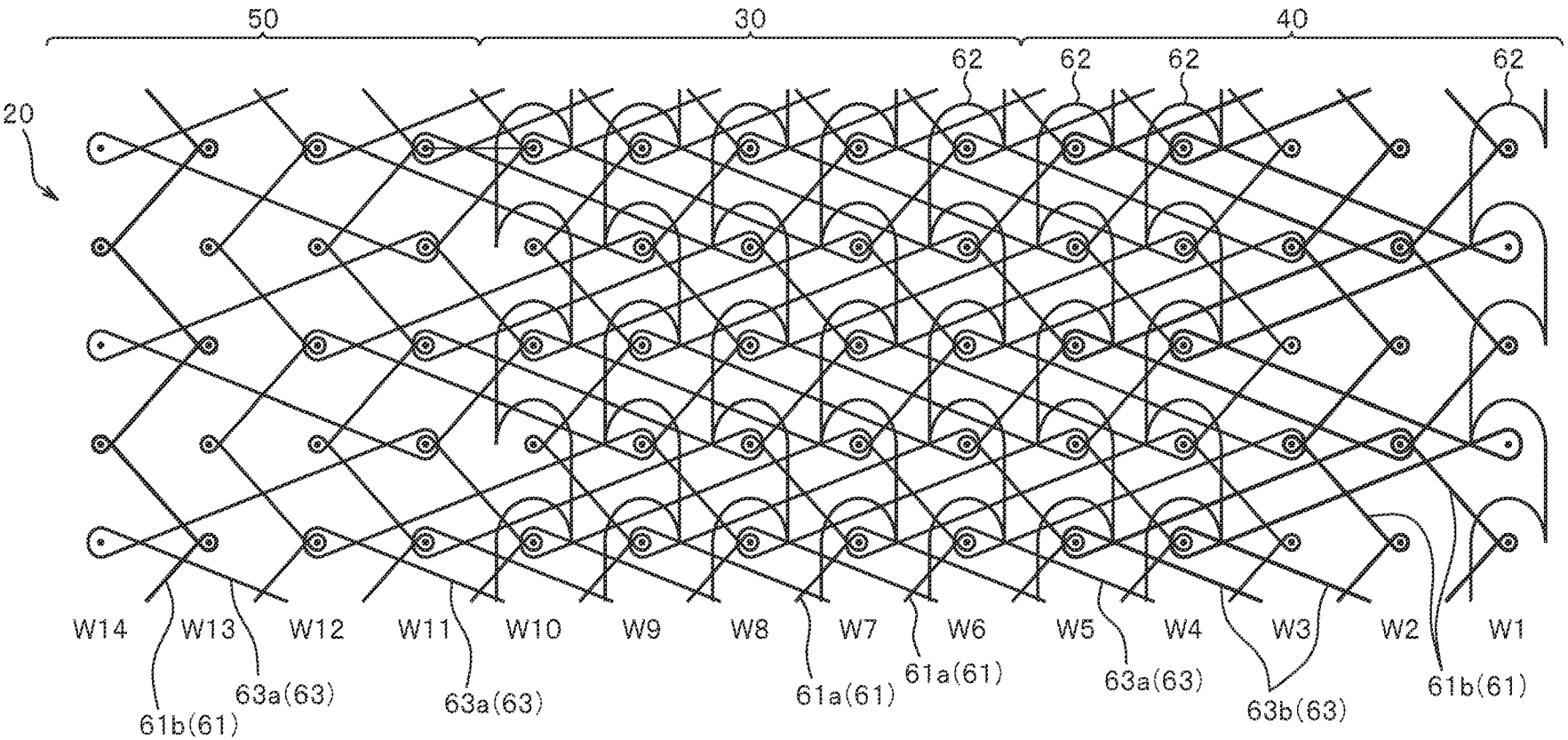
FIG. 2 is a structure diagram illustrating a knitting structure of a fastener tape in the fastener stringer illustrated in FIG. 1.
Figure 3:
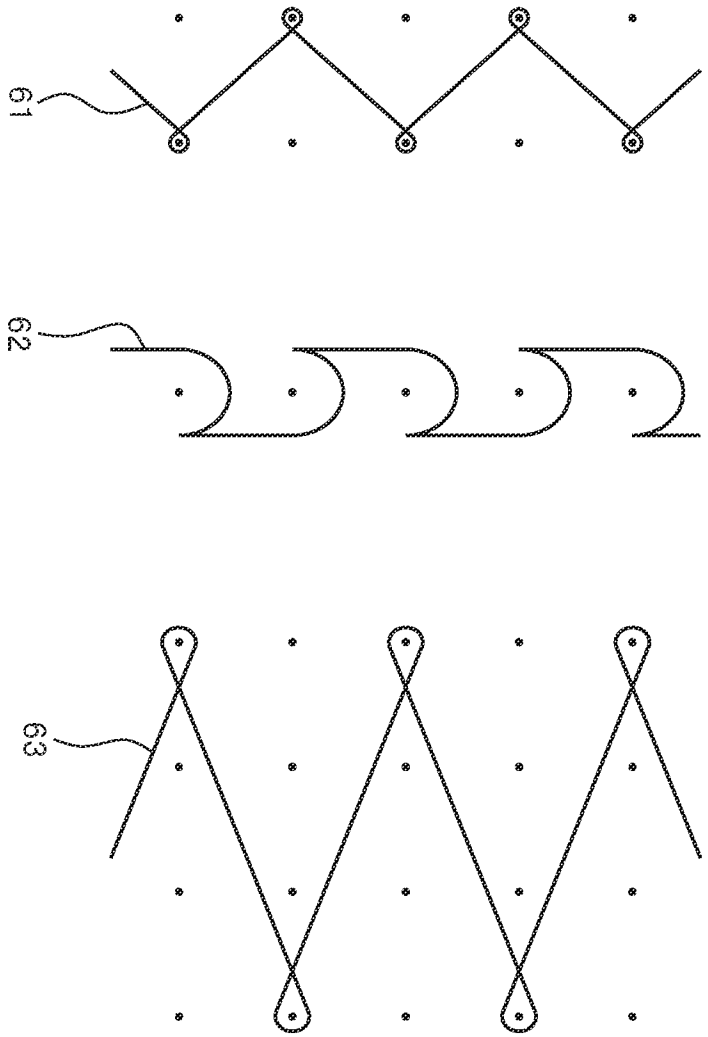
FIG. 3 is a structure diagram of each kind of yarn used for the fastener tape.

FIG. 1 is a cross-sectional view schematically illustrating a fastener stringer for a concealed slide fastener of this example. FIG. 2 is a structure diagram illustrating a knitting structure of a fastener tape in the fastener stringer illustrated in FIG. 1. FIG. 3 is a structure diagram of each yarn used for the fastener tape.

In the following description, a front-rear direction indicates a direction along the tape length direction of the fastener tape, and is a linear direction which is the same as the sliding direction in which the slider slides. A left-right direction indicates a direction along the width direction of a tape main body portion of the fastener tape, and is a direction parallel to the tape surface of the tape main body portion and orthogonal to the tape length direction. An upper-lower direction indicates a direction along a tape front-back direction orthogonal to a tape front surface and a tape back surface of the tape main body portion of the fastener tape, and is a direction orthogonal to the front-rear direction and the left-right direction.

Regarding the knitting structure of the fastener tape, a direction along the length direction (front-rear direction) of the fastener tape is defined as a wale direction, and a direction orthogonal to the wale direction is defined as a course direction. In addition, the course direction is a direction parallel to the tape surface extending along the width direction when the fastener tape is held in a planar shape.

A concealed slide fastener 1 of this example illustrated in FIG. 1 includes a pair of left and right fastener stringers 10 and a slider (not illustrated) slidably attached to element rows 11 formed in the left and right fastener stringers 10. The slider of this example has substantially the same structure as a slider typically used in a conventional concealed slide fastener. Thus, a specific description of the slider is omitted in this example.

Each of the left and right fastener stringers 10 includes an elongated fastener tape 20 knitted in a band shape and a plurality of fastener elements 12 sewn to the fastener tape 20 with machine sewing yarns (sewing yarns) 18.

The plurality of fastener elements 12 have a shape continuous in a coil shape along the length direction of the fastener tape 20, and are formed by molding a monofilament made of thermoplastic resin such as polyamide or polyester so that the monofilament is wound in a coil shape. The plurality of fastener elements 12 continuous in a coil shape are attached to an element attaching portion 21 of the fastener tape 20 along the length direction by multi-thread chain stitches of the machine sewing yarns 18 to form the element row 11.

As illustrated in FIG. 1, each fastener element 12 includes: a coupling head portion 13 engaging with the fastener element 12 as the engaging counterpart; an upper leg portion 14 and a lower leg portion 15 extending in the width direction from the coupling head portion 13; and a connecting portion 16 connecting the upper leg portion 14 (or the lower leg portion 15) of the fastener element 12 and the lower leg portion 15 (or the upper leg portion 14) of the fastener element 12 adjacent to this fastener element in the front-rear direction. The upper leg portion 14 and the lower leg portion 15 of the fastener element 12 extend in the width direction toward the tape inner side from an upper end portion and a lower end portion of the coupling head portion 13, respectively. The fastener element 12 is fixed to the fastener tape 20 in such a posture that the upper leg portion 14 is brought into contact with the fastener tape 20 and the lower leg portion 15 is separated from the fastener tape 20.

Each of the left and right fastener tapes 20 has a warp knitting structure knitted using a plurality of stitch yarns. As illustrated in FIGS. 1 and 2, each of the fastener tapes 20 includes: a tape main body portion 30; a doubled-tape portion 40 formed by extending in the width direction from one side edge portion of the tape main body portion 30 and being folded back; and a tape outer edge portion 50 extending in the width direction from the other side edge portion of the tape main body portion 30. Note that, FIG. 2 is a view illustrating a knitting structure in which the double section in FIG. 1 is not folded back (in an open state).

The doubled-tape portion 40 includes: a first tape portion 41 extending inward in the width direction from the tape main body portion 30; a tape bent portion 43 further extending from the first tape portion 41 and bent in a U shape; and a second tape portion 42 further extending from the tape bent portion 43, and the first tape portion 41 and the second tape portion 42 overlap with each other. The inward mentioned herein indicates a side close to side edge portions of the pair of fastener tapes 20 facing each other (a direction approaching the side edge portions). The second tape portion 42 of the doubled-tape portion 40 is provided with the element attaching portion 21 to which the fastener element 12 is sewn. The tape bent portion 43 of the doubled-tape portion 40 is formed so as to be capable of coming into contact with the tape bent portion 43 of the fastener tape 20 as the engaging counterpart when the concealed slide fastener 1 is closed (when the left and right element rows 11 are engaged).

As illustrated in FIGS. 2 and 3, the fastener tape 20 of this example is knitted with three types of stitch yarns: a tricot stitch yarn 61 (1-2/1-0); a chain stitch yarn 62 (0-1/1-0); and a single satin stitch yarn 63 (1-0/3-4). In this case, the tricot stitch yarn 61 and the single satin stitch yarn 63 are knitted so that a sinker loop of the tricot stitch yarn 61 and a sinker loop of the single satin stitch yarn 63 cross each other in each interval between courses.

In this example, the tricot stitch yarn 61, the chain stitch yarn 62, and the single satin stitch yarn 63 have a fineness of 56 T (decitex) or more and 167 T or less. In addition, in this example, the tricot stitch yarn 61 and the single satin stitch yarn 63 have the same fineness. This enables the fastener tape 20 to be easily knitted. Note that, in the invention, the fineness of each stitch yarn forming the fastener tape 20 is not particularly limited. In addition, the material of each stitch yarn is also not limited. For example, for the tricot stitch yarn 61, the chain stitch yarn 62, and the single satin stitch yarn 63, for example, a multifilament yarn made of polyester, nylon, polypropylene, acrylic, or the like, which has been used in a conventional fastener tape for a slide fastener, can be used.

The fastener tape 20 includes 14 rows of first to fourteen wales W1 to W14 from one tape side edge to the other tape side edge of the fastener tape 20. In this case, the wale formed on the tape side edge on the doubled-tape portion 40 side of the fastener tape 20 is defined as the first wale W1, and the second to fourteen wales W2 to W14 are sequentially formed in the course direction from the first wale W1 toward the tape side edge on the outer edge portion side.

The doubled-tape portion 40 of the fastener tape 20 is formed of five wales including the first to fifth wales W1 to W5. The tape main body portion 30 and the tape outer edge portion 50 are respectively formed of five wales including the sixth to tenth wales W6 to W10 and four wales including the eleventh to fourteenth wales W11 to W14. Note that, in the invention, the number of wales forming the fastener tape is not particularly limited, and the number of wales can be increased or decreased according to the use of the slide fastener and the like. Further, the number of wales forming each of the doubled-tape portion, the tape main body portion, and the tape outer edge portion is also not particularly limited.

The tape main body portion 30 formed by the sixth to tenth wales W6 to W10 is a portion of the fastener tape 20 sewn to, for example, a cloth of clothing or the like. The tape main body portion 30 is formed of the tricot stitch yarns 61, the chain stitch yarns 62, and the single satin stitch yarns 63.

A needle loop of the tricot stitch yarn 61, a needle loop of the chain stitch yarn 62, and a needle loop of the single satin stitch yarn 63 are formed in each of all the wales (sixth to tenth wales W6 to W10) forming the tape main body portion 30. In particular, in each of the sixth to ninth wales W6 to W9, three needle loops of the tricot stitch yarn 61, the chain stitch yarn 62, and the single satin stitch yarn 63 are formed in each course. In this case, in each course, the needle loop of the chain stitch yarn 62 is formed so as to tighten the needle loop of the tricot stitch yarn 61 and the needle loop of the single satin stitch yarn 63 from the outside. Note that, in the invention, the knitting structure of the tape main body portion is not particularly limited as long as the chain stitch yarn is included in each wale.

In this example, for the sixth to tenth wales W6 to W10 forming the tape main body portion 30, the wale width of one wale is defined as a first wale width. Here, the wale width of a wale indicates a maximum value of the dimension in the width direction or the course direction of a stitch formed by one needle loop or a plurality of needle loops in the wale. Thus, the first wale width can also be said to be a maximum value of the dimension in the width direction or the course direction of a stitch formed by interlacing the needle loop of the tricot stitch yarn 61, the needle loop of the chain stitch yarn 62, and the needle loop of the single satin stitch yarn 63.

As described above, the doubled-tape portion 40 is formed of the first to fifth wales W1 to W5. In this case, as illustrated in FIG. 1, the first and second wales W1 and W2 are arranged in the second tape portion 42 including the element attaching portion 21 of the doubled-tape portion 40.

The third wale W3 is disposed in the tape bent portion 43 of the doubled-tape portion 40. The fourth and fifth wales W4 and W5 are arranged in the first tape portion 41 of the doubled-tape portion 40. The machine sewing yarn 18 for sewing the fastener elements 12 to the element attaching portion 21 pierces between the first and second wales W1 and W2 and between the second and third wales W2 and W3 in the doubled-tape portion 40.

The doubled-tape portion 40 is formed using the tricot stitch yarns 61, the chain stitch yarns 62, and the single satin stitch yarns 63. More specifically, in the first wale W1 formed at the tape side edge and the fourth and fifth wales W4 and W5 forming the first tape portion 41 adjacent to the tape main body portion 30, a needle loop of the tricot stitch yarn 61, a needle loop of the chain stitch yarn 62, and a needle loop of the single satin stitch yarn 63 are formed in each wale. In particular, in each of the fourth and fifth wales W4 and W5, three needle loops of the tricot stitch yarn 61, the chain stitch yarn 62, and the single satin stitch yarn 63 are formed in each course.

The second and third wales W2 and W3 of the doubled-tape portion 40 are formed of two types of stitch yarns: the tricot stitch yarn 61; and the single satin stitch yarn 63. In other words, no needle loop of the chain stitch yarn 62 is formed in the second and third wales W2 and W3, and two types of needle loops of the tricot stitch yarn 61 and the single satin stitch yarn 63 are formed. In addition, in the second and third wales W2 and W3, a stitch in which only a needle loop of the tricot stitch yarn 61 is formed and a stitch formed by interlacing a needle loop of the tricot stitch yarn 61 and a needle loop of the single satin stitch yarn 63 are alternately formed in the wale direction.

In the doubled-tape portion 40, in the second and third wales W2 and W3 not including the needle loop of the chain stitch yarn 62, since the needle loop of the tricot stitch yarn 61 or the needle loops of the tricot stitch yarn 61 and the single satin stitch yarn 63 is/are not tightened from the outside by the needle loop of the chain stitch yarn 62, the needle loop of the tricot stitch yarn 61 or the two needle loops of the tricot stitch yarn 61 and the single satin stitch yarn 63 is/are formed to be loosened in each course and bulged in the width direction.

Here, for the second and third wales W2 and W3 of the doubled-tape portion 40 not including the chain stitch yarn 62, a maximum value of the dimension in the width direction or the course direction of a stitch formed by one or two needle loops in each course is defined as a second wale width. In particular, in the case of this example, the wale width (the maximum value of the dimension in the width direction) of the stitch formed by interlacing the needle loop of the tricot stitch yarn 61 and the needle loop of the single satin stitch yarn 63 is larger than the wale width of the stitch formed only by the needle loop of the tricot stitch yarn 61, but in this example, the wale width of the stitch formed only by the needle loop of the tricot stitch yarn 61 is defined as the second wale width.

In this example, since no chain stitch yarn 62 is knitted in the second and third wales W2 and W3 of the doubled-tape portion 40 as described above, the second and third wales are each formed as a wide wale in which the dimension in the width direction of the stitch formed by the needle loop is larger than that in each of the sixth to tenth wales W6 to W10 forming the tape main body portion 30.

In other words, the second and third wales W2 and W3 (wide wales) are each formed to have the second wale width (width dimension of the stitch formed only by the needle loop of the tricot stitch yarn 61) larger than the above-described first wale width of each of the sixth to tenth wales W6 to W10. In this case, in the second and third wales W2 and W3, the wale width of the stitch formed by interlacing the needle loops of the tricot stitch yarn 61 and the single satin stitch yarn 63 with each other is larger than the wale width (second wale width) of the stitch formed only by the needle loop of the tricot stitch yarn 61, and thus is inevitably larger than the above-described first wale width of each of the sixth to tenth wales W6 to W10. In addition, in this case, the second wale width of each of the second and third wales W2 and W3 is larger than the wale width of each of the first, fourth, and fifth wales W1, W4, and W5 in which the chain stitch yarn 62 is knitted in the doubled-tape portion 40.

Since the second and third wales W2 and W3 of the doubled-tape portion 40 are each formed of the above-described wide wale that does not include the chain stitch yarn 62 knitted continuously in the wale direction, the needle loops formed in the second and third wales W2 and W3 can be loosened. In other words, the needle loop formed in each of the second and third wales W2 and W3 is knitted in a loose state, so that the dimension in the width direction of the needle loop is increased.

Since the needle loops of the second and third wales W2 and W3 are loosened in this manner, it is possible to improve the stretchability of the doubled-tape portion 40 in the wale direction (length direction) and the flexibility of the doubled-tape portion 40. In particular, in the case of this example, the second and third wales W2 and W3, which are the wide wales, are arranged adjacent to the position where the machine sewing yarns 18 pierce through the doubled-tape portion 40 in the course direction. Specifically, the machine sewing yarns 18 are disposed between the first wale W1 and the second wale W2, which is the wide wale, and between the second and third wales W2 and W3 which are the wide wales.

In addition, the third wale W3 is disposed in the tape bent portion 43 of the doubled-tape portion 40 in which the flexibility of the fastener tape 20 in the tape front-back direction is likely to be reduced. Since the second wale W2 and the third wale W3 arranged at such a position (that is, a position adjacent to the pierce position of the machine sewing yarn 18 and/or a position of the tape bent portion 43) are formed as wide wales, the flexibility (in particular, the flexibility in the tape front-back direction) of the doubled-tape portion 40 can be more effectively enhanced. Since the machine sewing yarns 18 are disposed adjacent to the wide wale in which the needle loop is loosened, the machine sewing yarn can slightly move according to the movement at the time of bending or sitting, the hardness of the concealed slide fastener 1 is less likely to be felt.

Here, disposing the machine sewing yarns 18 adjacent to the wide wale means that the machine sewing yarns 18 pierce between the wide wale and the wale adjacent to this wide wale. In this case, the machine sewing yarns 18 may pierce through the doubled-tape portion between the wide wale and the wide wale adjacent to this wide wale, for example, between the second wale W2 and the third wale W3, or may pierce through the doubled-tape portion between the wide wale and the non-wide wale (the wale that is not the wide wale) adjacent to this wide wale, for example, between the first wale W1 and the second wale W2.

In the doubled-tape portion 40 of the fastener tape 20, in the first wale W1 formed at the tape side edge of the fastener tape 20, a stitch formed by interlacing the needle loops of the tricot stitch yarn 61 and the chain stitch yarn 62 each other and a stitch formed by interlacing the needle loops of the single satin stitch yarn 63 and the chain stitch yarn 62 each other are alternately formed in the wale direction. Thus, the strength of the tape side edge of the fastener tape 20 can be secured, and the tape shape of the fastener tape 20 can be stabilized. As a result, the coil-shaped fastener element 12 can be stably fixed at a predetermined position of the element attaching portion 21 of the fastener tape 20.

Further, the chain stitch yarn 62 disposed in the first wale W1 has higher strength than the other chain stitch yarns 62 disposed in each of the fourth to tenth wales W4 to W10. Accordingly, the strength of the tape side edge of the fastener tape 20 can be further enhanced. In addition, in the case of this example, the chain stitch yarn 62 disposed in the first wale W1 has the same fineness as the other chain stitch yarns 62.

As described above, the tape outer edge portion 50 of the fastener tape 20 is formed of four wales including the eleventh to fourteenth wales W11 to W14. The tape side edge (the fourteenth wale W14) of the fastener tape 20 on the tape outer edge portion 50 side is also referred to as an ear portion. This tape outer edge portion 50 is formed of the tricot stitch yarn 61 and the single satin stitch yarn 63, and no chain stitch yarn 62 is disposed in the tape outer edge portion 50.

In the tape outer edge portion 50 of this example, in the eleventh wale W11 adjacent to the tape main body portion 30, the two needle loops of the tricot stitch yarn 61 and the single satin stitch yarn 63 are formed in each course. In the twelfth wale W12 adjacent to the eleventh wale W11 on its tape outer side (the side away from the tape main body portion 30), the stitch formed by the two needle loops of the tricot stitch yarn 61 and the single satin stitch yarn 63 and the stitch formed only by the needle loop of the tricot stitch yarn 61 are alternately formed in the wale direction. In the thirteen and fourteenth wales W13 and W14 arranged on the tape outer side of the twelfth wale W12, the needle loop of only one of the tricot stitch yarn 61 and the single satin stitch yarn 63 is formed in each course.

Since the tape outer edge portion 50 has a portion where the proportion of needle loops formed in each wale is gradually reduced toward the tape outer side as described above, the flexibility of the tape outer edge portion 50 can be improved. For example, in the case of this example, since the tape outer edge portion 50 is formed of the above-described knitting structure, the flexibility in the tape width direction and the flexibility in the tape front-back direction are enhanced.

Furthermore, in this example, in the fourteenth wale W14 formed at the tape side edge (ear portion) of the fastener tape 20, one needle loop of the tricot stitch yarn 61 and one needle loop of the single satin stitch yarn 63 are alternately formed in the wale direction. Since one needle loop is formed in each course of the fourteenth wale W14 forming the ear portion in this manner, it is possible not only to improve the flexibility of the tape outer edge portion 50 as described above, but also to enhance the strength of the tape outer edge portion 50.

In this example, the tricot stitch yarns 61 knitted into the fastener tape 20 include a plurality of first tricot stitch yarns 61*a* forming needle loops in the third to thirteen wales W3 to W13 including the tape main body portion 30, and second tricot stitch yarns 61*b* having a higher strength than the first tricot stitch yarns 61*a*. In the case of this example, the second tricot stitch yarn 61*b* has the same fineness as the first tricot stitch yarns 61*a*, and has higher strength by 2.0 cN/T or more, preferably 5.0 cN/T or more than the first tricot stitch yarns 61*a*. Note that, in the invention, the second tricot stitch yarn 61*b* may be formed of a yarn having larger fineness than the first tricot stitch yarns 61*a* instead of or in addition to having higher strength than the first tricot stitch yarns 61*a*.

The second tricot stitch yarns 61*b* described above are used for the tricot stitch yarn 61 that forms a needle loop in the second wale W2 (wide wale) sandwiched between the machine sewing yarns 18. Specifically, the second tricot stitch yarns 61*b* are used for the tricot stitch yarn 61 disposed to extend across the first and second wales W1 and W2, and the tricot stitch yarn 61 disposed to extend across the second and third wales W2 and W3.

The single satin stitch yarns 63 knitted into the fastener tape 20 include a plurality of first single satin stitch yarns 63*a* forming needle loops in the third to twelfth wales W3 to W12 including the tape main body portion 30 and the fourteenth wale W14, and second single satin stitch yarns 63*b* having higher strength than the first single satin stitch yarns 63*a*. In the case of this example, the second single satin stitch yarn 63*b* has the same fineness as the first single satin stitch yarns 63*a*, and has higher strength by 2.0 cN/T or more, preferably 5.0 cN/T or more than the first single satin stitch yarns 63*a*. Note that, in the invention, the second single satin stitch yarn 63*b* may be formed of a yarn having larger fineness than the first single satin stitch yarns 63*a* instead of or in addition to having higher strength than the first single satin stitch yarns 63*a*.

The second single satin stitch yarns 63*b* described above are used for the single satin stitch yarn 63 forming a needle loop in the second wale W2 (wide wale) sandwiched between the machine sewing yarns 18 and the single satin stitch yarn 63 crossing the second wale W2. Specifically, the second single satin stitch yarns 63*b* are used for the single satin stitch yarn 63 that alternately forms needle loops in the wale direction in the first and fourth wales W1 and W4, and the single satin stitch yarn 63 that alternately forms needle loops in the wale direction in the second and fifth wales W2 and W5.

Since the second tricot stitch yarn 61*b* and the second single satin stitch yarn 63*b* are arranged with respect to the second wale W2 as described above, the strength of the doubled-tape portion 40 (in particular, the strength of the element attaching portion 21) is enhanced, so that the fastener element 12 can be stably fixed to the element attaching portion 21. Further, this makes the breakage of a yarn less likely to occur in the doubled-tape portion 40 even if the sliding operation of the slider is repeated.

In this example, the second tricot stitch yarn 61*b* having high strength is also used for the tricot stitch yarn 61 disposed to extend across the thirteenth and fourteenth wales W13 and W14. Accordingly, the strength of the tape outer edge portion 50 of the fastener tape 20 can be further enhanced.

Next, a method for manufacturing the fastener stringer 10 of this example described above will be described.

Figure 4:
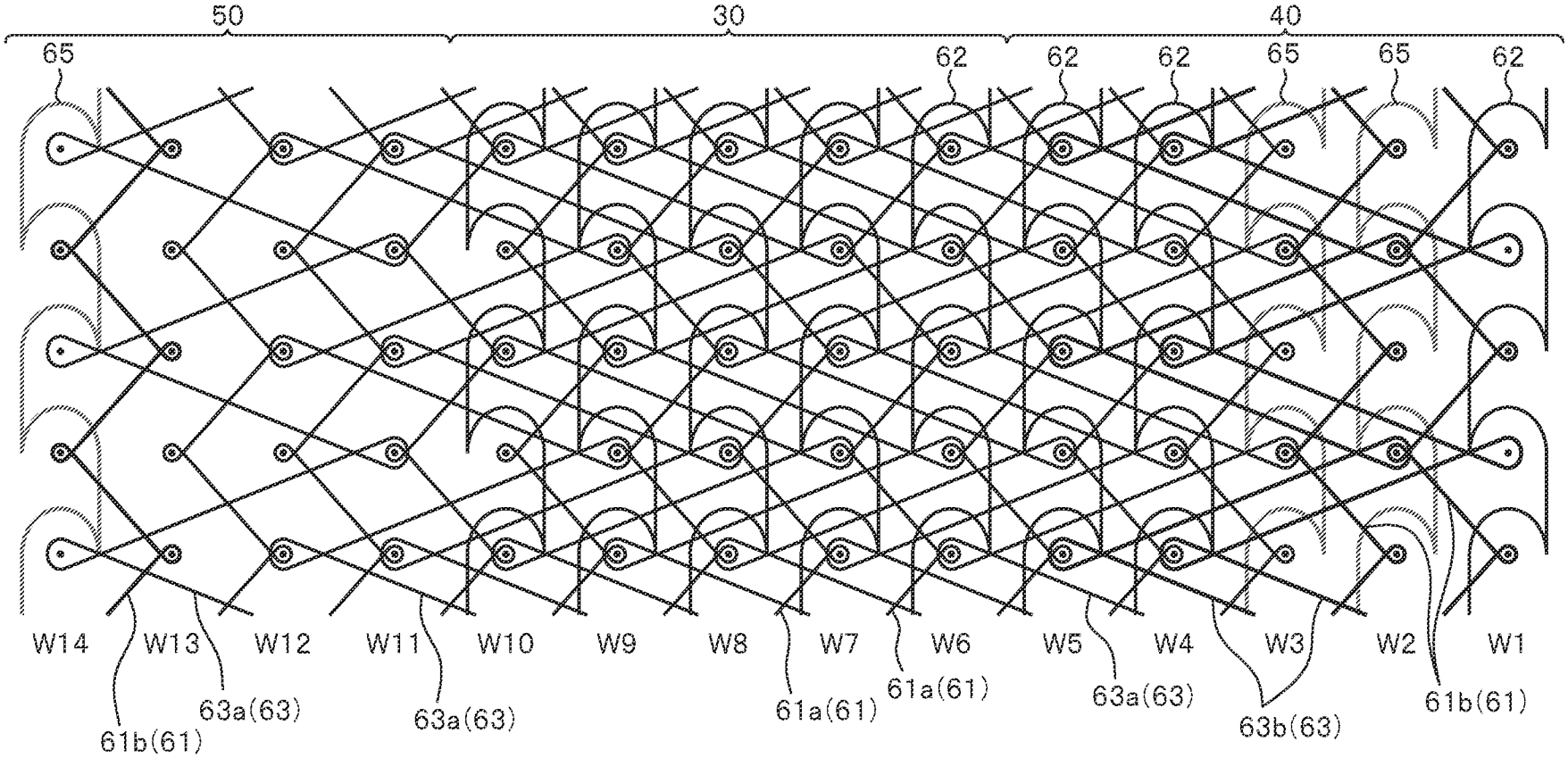
FIG. 4 is a structure diagram illustrating a knitting structure of the fastener tape including a water-soluble stitch yarn after knitting.
Figure 5:
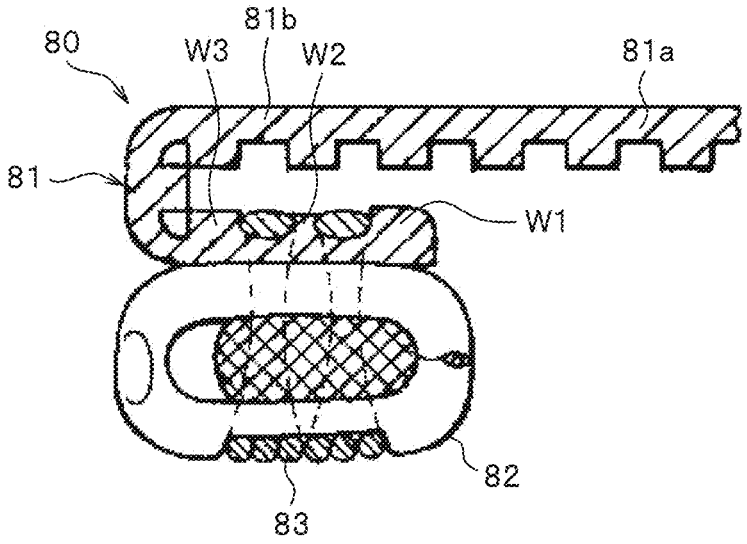
FIG. 5 is a cross-sectional view illustrating a conventional fastener stringer for a concealed slide fastener.

First, knitting processing of knitting the fastener tape 20 using a warp knitting machine is performed. The fastener tape 20 knitted by this knitting processing has a knitting structure illustrated in FIG. 4 in which the chain stitch yarn 62 is knitted into each wale forming the tape main body portion 30, and a water-soluble chain stitch yarn 65 is knitted into at least one of the wales forming the doubled-tape portion 40.

Specifically, the fastener tape 20 knitted by the warp knitting machine is formed by adding three water-soluble chain stitch yarns 65 (0-1/1-0) to the knitting structure of the fastener tape 20 of the fastener stringer 10 illustrated in FIG. 2. In this case, the water-soluble chain stitch yarns 65 are arranged in the second and third wales W2 and W3, and the fourteenth wale W14 forming the ear portion of the fastener tape 20 knitted by the warp knitting machine. In the invention, the water-soluble chain stitch yarn 65 is a yarn having a property of being melted or dissolved in a liquid such as water.

By knitting the fastener tape 20 using the water-soluble chain stitch yarn 65 as described above, the tape shape of the knitted fastener tape 20 can be stabilized. In particular, the water-soluble chain stitch yarn 65 of the second and third wales W2 and W3 is knitted into each wale in such a manner as to tighten the needle loop of the tricot stitch yarn 61 from the outside, or in such a manner as to tighten both the needle loop of the tricot stitch yarn 61 and the needle loop of the single satin stitch yarn 63 from the outside. Thus, between the first and second wales W1 and W2 and between the second and third wales W2 and W3 of the fastener tape 20 knitted by the warp knitting machine, an appropriate interval having, for example, the same size or substantially the same size as the interval between the adjacent wales of the tape main body portion 30 is stably provided.

Next, sewing processing of sewing, using a sewing machine, the plurality of fastener elements 12, continuous in a coil shape, on the fastener tape 20 knitted by the warp knitting machine is performed. In this sewing processing, a sewing-machine needle of the sewing machine is moved up and down at the position of the interval between the first and second wales W1 and W2 and the position of the interval between the second and third wales W2 and W3, so that the machine sewing yarns (sewing yarns) 18 pierce through the above-described two intervals to form a sewing portion by multi-thread stitching of the machine sewing yarns 18. At the same time, the plurality of fastener elements 12 are fixed to the doubled-tape portion 40 of the fastener tape 20 (the element attaching portion 21 of the doubled-tape portion 40) by the sewing portion thus formed.

At this time, the interval between the first and second wales W1 and W2 and the interval between the second and third wales W2 and W3 are formed to have appropriate sizes by knitting the water-soluble chain stitch yarn 65 into the second and third wales W2 and W3 as described above. Thus, it is possible to prevent the sewing-machine needle from interfering with the first to third wales W1 to W3 when the sewing-machine needle moves up and down. This can make it difficult to cause problems such as displacing the position where the machine sewing yarns 18 pierce through the fastener tape 20 and the cutting of the stitch yarn of the fastener tape 20 by the sewing-machine needle due to the interference of the sewing-machine needle.

As a result, the fastener elements 12 can be attached to predetermined positions of the fastener tape 20 at constant pitches in the length direction. In addition, it is possible to suppress a decrease in the strength of the fastener tape 20 (in particular, the strength of the element attaching portion 21). By performing such sewing processing, the fastener stringer 10 in which the fastener elements 12 are sewn to the fastener tape 20 is manufactured.

Next, a process of dissolving and removing the water-soluble chain stitch yarns 65 knitted into the fastener tape 20 is performed by immersing the manufactured fastener stringer 10 in a liquid, for example. In this example, before the water-soluble chain stitch yarn 65 is dissolved, the form of the fastener tape 20 may be fixed by folding back a part of the fastener tape 20 of the manufactured fastener stringer 10 to form the doubled-tape portion 40 in the fastener tape 20, and applying heat setting to the fastener stringer 10 in which the doubled-tape portion 40 is formed. Note that, the step of fixing the form of the fastener tape 20 in this manner may be performed after dyeing processing to be described later.

As an example of a method for dissolving the water-soluble chain stitch yarn 65 contained in the fastener tape 20, for example, in the dyeing processing for dyeing the fastener stringer 10, the water-soluble chain stitch yarn 65 can be dissolved in a dyeing solution and removed from the fastener tape 20 by immersing the fastener stringer 10 in the dyeing solution. By dissolving the water-soluble chain stitch yarn 65 disposed on the outermost side of the loops constituting the wales and removing it from the fastener tape 20 in this manner, the needle loop of the tricot stitch yarn 61 and/or the needle loop of the single satin stitch yarn 63 fastened by the water-soluble chain stitch yarn 65 from the outside can be loosened and enlarged (bulged).

As a result, the wale width of each of the second and third wales W2 and W3 of the fastener tape 20 can be made larger than the wale width (first wale width) of each of the sixth to tenth wales W6 to W10 forming the tape main body portion 30, so that the second and third wales W2 and W3 are each formed as a wide wale having the second wale width larger than the first wale width. Further, by removing the water-soluble chain stitch yarns 65 from the fastener tape 20, the thickness of the doubled-tape portion 40 can be reduced. Note that, in the invention, the method for dissolving and removing the water-soluble chain stitch yarns 65 contained in the fastener tape 20 is not limited to the dyeing processing of immersing the fastener stringer 10 in the dyeing solution, and other processing or treatment can be employed.

By performing the above process, the fastener stringer 10 used for the concealed slide fastener 1 illustrated in FIG. 1 can be reliably manufactured.

Further, by combining the two manufactured fastener stringers 10 and slidably attaching a slider (not illustrated) to the element rows 11 of the combined pair of fastener stringers 10, the concealed slide fastener 1 of this example illustrated in FIG. 1 is manufactured.

According to the concealed slide fastener 1 of this example manufactured as described above, since the doubled-tape portion 40 of the fastener tape 20 includes the wide wale not including the chain stitch yarn 62 continuously knitted in the wale direction as described above, the flexibility of the fastener tape 20 (in particular, the doubled-tape portion 40 of the fastener tape 20) can be enhanced. Further, in this example, since the second and third wales W2 and W3 arranged in the doubled-tape portion 40 of the fastener tape 20 are formed as wide wales having a large wale width, each of the left and right fastener stringers 10 has high stretchability in the wale direction (length direction) and excellent flexibility that makes the fastener tape 20 easily bendable in the tape front-back direction.

As a result, in a case where the concealed slide fastener 1 of this example is attached to, for example, a placket portion of clothing or the like and used, it is possible to inhibit a hard portion (stiffened portion), a convex portion bulging away from the body, a concave portion recessed toward the body between the two convex portions, and the like from being generated in a portion of the clothing where the concealed slide fastener 1 is attached when a person wearing the clothing bends down or sits on a chair, which would otherwise be generated when a conventional concealed slide fastener is used. Thus, by using the concealed slide fastener 1 of this example, it is possible to inhibit the wear comfort of the clothing to which the concealed slide fastener 1 is attached from being deteriorated, and inhibit the beauty of the silhouette, the design, and the like of the clothing from being impaired by the concealed slide fastener 1.

In addition, in the concealed slide fastener 1 of this example, in the fourteenth wale W14 formed at the tape side edge (ear portion) on the tape outer edge portion 50 side of the fastener tape 20, as described above, one needle loop of the tricot stitch yarn 61 and one needle loop of the single satin stitch yarn 63 are alternately formed in the wale direction. Thus, the tape outer edge portion 50 of the fastener tape 20 can ensure appropriate strength, and the flexibility of the tape outer edge portion 50 can be improved.

Accordingly, for example, even when the portion of the clothing to which the concealed slide fastener 1 is attached is formed in a shape curved to the left or right with respect to the length direction of the fastener tape 20, the concealed slide fastener 1 of this example can be stably sewn to the portion of the clothing to which the concealed slide fastener is attached while being curved so as to follow the shape of the portion of the clothing. In addition, even when the concealed slide fastener 1 is attached in a curved state to the portion of the clothing to which the concealed slide fastener is attached, it is possible to inhibit the formation of wrinkles and wavy uneven portions on the fastener tapes 20 of the concealed slide fastener 1. Thus, it is possible to finish the clothing to which the concealed slide fastener 1 is sewn in a well-looking shape.

Note that, the invention is not limited to the embodiment described above, and various modifications can be made as long as they have substantially the same configuration and exhibit the same operation and effect as the invention.

For example, in the above-described embodiment, as illustrated in FIG. 2, the second and third wales W2 and W3 among the first to fifth wales W1 to W5 forming the doubled-tape portion 40 of the fastener tape 20 are formed as wide wales not including the chain stitch yarn 62. However, in the invention, it is sufficient for at least one of the first to fifth wales W1 to W5 forming the doubled-tape portion 40 to be formed as a wide wale not including the chain stitch yarn 62.

For example, in the invention, only the second wale W2 among the first to fifth wales W1 to W5 may be formed as a wide wale not including the chain stitch yarn 62, or all of the first to fifth wales W1 to W5 may be formed as wide wales not including the chain stitch yarn 62. In this case, although the flexibility can be enhanced by increasing the number of wide wales formed in the doubled-tape portion 40, it is also conceivable that the strength of the doubled-tape portion 40 is reduced. Thus, as in the above-described embodiment, it is preferable that two of the first to fifth wales W1 to W5, i.e., the second and third wales W2 and W3 are formed as wide wales.

Further, the fastener tape 20 of the above-described embodiment is formed using the three types of stitch yarns including the tricot stitch yarn 61, the chain stitch yarn 62, and the single satin stitch yarn 63, but in the invention, the fastener tape may be formed using a weft insertion yarn instead of the single satin stitch yarn 63. In other words, the fastener tape of the invention may be formed using the tricot stitch yarn 61, the chain stitch yarn 62, and the weft insertion yarn. In this case, in the fastener tape 20 of the example formed using the tricot stitch yarn 61, the chain stitch yarn 62, and the single satin stitch yarn 63 described above, since the single satin stitch yarn 63 forms a needle loop and is knitted, the needle loop is easily deformed as compared with, for example, a fastener tape formed using a weft insertion yarn instead of the single satin stitch yarn 63, and thus the flexibility of the fastener tape 20 can be further enhanced.

REFERENCE SIGNS LIST

1 CONCEALED SLIDE FASTENER
10 FASTENER STRINGER
11 ELEMENT ROW
12 FASTENER ELEMENT
13 COUPLING HEAD PORTION
14 UPPER LEG PORTION
15 LOWER LEG PORTION
16 CONNECTING PORTION
18 MACHINE SEWING YARN (SEWING YARN)
20 FASTENER TAPE
21 ELEMENT ATTACHING PORTION
30 TAPE MAIN BODY PORTION
40 DOUBLED-TAPE PORTION
41 FIRST TAPE PORTION
42 SECOND TAPE PORTION
43 TAPE BENT PORTION
50 TAPE OUTER EDGE PORTION
61 TRICOT STITCH YARN
61*a* FIRST TRICOT STITCH YARN
61*b* SECOND TRICOT STITCH YARN
62 CHAIN STITCH YARN
63 SINGLE SATIN STITCH YARN
63*a* FIRST SINGLE SATIN STITCH YARN
63*b* SECOND SINGLE SATIN STITCH YARN
65 WATER-SOLUBLE CHAIN STITCH YARN
W1 to W14 FIRST TO FOURTEENTH WALES

The invention claimed is:

1. A concealed slide fastener including a pair of fastener stringers, each of the fastener stringers including a knitted fastener tape and a plurality of fastener elements attached to an element attaching portion of the knitted fastener tape with machine sewing yarns, the knitted fastener tape including a tape main body portion and a doubled-tape portion along a longitudinal edge of the knitted fastener tape forming, in cross-section, a U-shape with a first tape portion of the U-shape extending from a longitudinal portion of the tape main body portion, the doubled-tape portion including the element attaching portion, wherein at least a chain stitch yarn is included in each of a plurality of wales forming the tape main body portion, and a plurality of wales forming the doubled-tape portion include at least one wide wale having a second wale width that is greater than a first wale width of the plurality of wales forming the tape main body portion, wherein, when a wale formed on a tape side edge on the doubled-tape portion of the knitted fastener tape is defined as a first wale, the doubled-tape portion is formed of five wales from the first wale to a fifth wale, and a second wale and a third wale forming the doubled-tape portion are each formed as the at least one wide wale.

2. A concealed slide fastener including a pair of fastener stringers, each of the fastener stringers including a knitted fastener tape and a plurality of fastener elements attached to an element attaching portion of the knitted fastener tape with machine sewing yarns, the knitted fastener tape including a tape main body portion and a doubled-tape portion along a longitudinal edge of the knitted fastener tape forming, in cross-section, a U-shape with a first tape portion of the U-shape extending from a longitudinal portion of the tape main body portion, the doubled-tape portion including the element attaching portion, wherein at least a chain stitch yarn is included in each of a plurality of wales forming the tape main body portion, and a plurality of wales forming the doubled-tape portion include at least one wide wale having a second wale width that is greater than a first wale width of the plurality of wales forming the tape main body portion, wherein the tape main body portion and the doubled-tape portion include tricot stitch yarns and single satin stitch yarns, the tricot stitch yarns include a first tricot stitch yarn and a second tricot stitch yarn having higher strength or larger fineness than the first tricot stitch yarn and having a needle loop formed in the doubled-tape portion, and the single satin stitch yarns include a first single satin stitch yarn and a second single satin stitch yarn having higher strength or larger fineness than the first single satin stitch yarn and having a needle loop formed in the doubled-tape portion.

3. A method for manufacturing a concealed slide fastener including a pair of fastener stringers, each of the fastener stringers including a knitted fastener tape and a plurality of fastener elements attached to an element attaching portion of the knitted fastener tape with machine sewing yarns, the knitted fastener tape including a tape main body portion and a doubled-tape portion that is formed by extending in a width direction from the tape main body portion and being folded back, the doubled-tape portion including the element attaching portion, wherein the method comprises:

knitting the knitted fastener tape in which at least a chain stitch yarn is included in each of a plurality of wales forming the tape main body portion and a water-soluble chain stitch yarn is included in at least one of wales forming the doubled-tape portion;

sewing the plurality of fastener elements to the element attaching portion of the knitted fastener tape by a sewing processing using a sewing machine; and dissolving and removing the water-soluble chain stitch yarn of the knitted fastener tape to which the plurality of fastener elements are sewn to form, in the doubled-tape portion, at least one wide wale having a second wale width that is greater than a first wale width of the plurality of wales forming the tape main body portion.

4. The method for manufacturing a concealed slide fastener according to claim 3, wherein the method includes sewing the plurality of fastener elements to the element attaching portion by piercing at least one of the machine sewing yarns between a wale including the water-soluble chain stitch yarn and a wale adjacent to the wale including the water-soluble chain stitch yarn in the doubled-tape portion in the sewing processing.

* * * * *